US006073873A

United States Patent [19]

Shore et al.

[11] Patent Number: 6,073,873

[45] Date of Patent: Jun. 13, 2000

[54] COIL FORMING APPARATUS AND METHOD

[75] Inventors: T. Michael Shore, Princeton; Melicher Puchovsky, Dudley; Raymond R. Starvaski, Worcester, all of Mass.

[73] Assignee: Morgan Construction Company, Worcester, Mass.

[21] Appl. No.: 08/970,901

[22] Filed: Nov. 14, 1997

[51] Int. Cl.[7] ..... B21C 47/02; B21C 47/24

[52] U.S. Cl. ..... 242/363

[58] Field of Search ..... 242/360, 361.1, 242/361.2, 361.3, 361.4, 361.5, 363, 362.4, 362.5; 140/2

[56] References Cited

U.S. PATENT DOCUMENTS

| | | | |
|---|---|---|---|
| Re. 35,440 | 2/1997 | Starvaski | 242/363 |
| 2,779,551 | 1/1957 | Penitz . | |
| 3,088,690 | 5/1963 | Haugwitz . | |
| 3,618,871 | 11/1971 | Gilvar | 242/363 |
| 3,646,655 | 3/1972 | Geipel et al. . | |
| 4,357,965 | 11/1982 | Kosuge et al. . | |
| 4,437,620 | 3/1984 | Ozawa . | |
| 5,501,410 | 3/1996 | Starvaski | 242/363 |
| 5,735,477 | 4/1998 | Shore et al. | 242/363 |

FOREIGN PATENT DOCUMENTS 52-87638 of 1975 Japan .

*Primary Examiner*—John M. Jillions
*Attorney, Agent, or Firm*—Samuels, Gauthier & Stevens

[57] ABSTRACT

A method and apparatus is disclosed for receiving a helical formation of rings free falling from the delivery end of a conveyor and for gathering the rings into an upstanding cylindrical coil, The free falling rings encircle a vertically disposed guide and are supported initially on elevated intercepting elements. The interceptor elements are gradually lowered past a coil plate onto which the accumulated rings are transferred. The coil plate is then lowered to accommodate continued formation of the coil, and the intercepting elements are returned to their elevated position.

6 Claims, 6 Drawing Sheets

COIL FORMING APPARATUS AND METHOD

BACKGROUND OF THE INVENTION

1. Field of the Invention

This invention relates generally to rod rolling mills where hot rolled steel rod is formed into a continuous series of rings, and the rings are deposited in an overlapping pattern on a conveyor on which they are subjected to controlled cooling. The invention is concerned in particular with an improvement in the reforming chambers employed to receive and gather the rings into coils as they free fall from the delivery ends of the cooling conveyors.

2. Description of the Prior Art

In the conventional reforming chambers, the rings free fall in a helical formation into a cylindrical enclosure. The rings alight on a coil plate where they accumulate in coil form around a central guide. The coil plate is lowered to compensate for the growing height of the coil.

The central guide includes an upper nose cone which is separable from and carried on an underlying mandrel. A ring distributor rotates continuously around the nose cone to distribute the free falling rings in a controlled pattern designed to maximize coil density and to insure a subsequent smooth tangle-free payoff of the coiled rod.

When a full coil has been accumulated around the mandrel, interceptor elements are operatively positioned across the path of ring descent at a fixed level spaced above that of the maximum elevation of the coil plate. The operatively positioned interceptor elements engage and temporarily support the nose cone. Thereafter, as the initial rings of the next coil begin to accumulate on the interceptor elements, the mandrel is shifted from beneath the nose cone to accommodate removal of the just completed coil from the reforming chamber. An empty mandrel is located beneath the nose cone, and the coil plate is returned to its maximum elevation. The interceptor elements are then retracted, causing the rings accumulated thereon to drop abruptly onto the underlying coil plate.

This abrupt drop temporarily increases the free-fall distance of the rings, which in turn disturbs the controlled distribution being effected by the ring distributor rotating about the nose cone. As the rings land on the coil plate, they bounce and sometimes overlap each other, producing a random pattern that contributes to both a poorly formed and tall coil. Ring overlapping is a major cause of tangles and breaks during subsequent rod payoff.

A primary objective of the present invention is to achieve a smooth transfer of rings from their temporarily accumulated position on the interceptor elements to the coil plate, thereby avoiding the detrimental consequences of the abrupt drop experienced with conventional arrangements.

A companion objective of the present invention is to maintain a relatively constant free-fall distance of rings throughout the coil forming operation, thus preserving the controlled distribution produced by the ring distributor rotating continuously around the nose cone.

SUMMARY OF THE INVENTION

In accordance with the present invention, the ring interceptor elements no longer support the nose cone while the underlying mandrel is shifted to a coil discharge position. Instead, the nose cone is temporarily supported by other components, and the interceptor elements are adapted to be lowered gradually, thereby maintaining a relatively constant free fall distance for the rings. As the interceptor elements are lowered past the elevated coil plate, a beneficially smooth transfer of any temporarily accumulated rings is achieved from the interceptor elements onto the coil plate, which then continues to lower throughout the remainder of the coil forming operation.

DESCRIPTION OF PREFERRED EMBODIMENTS

Figure 1:
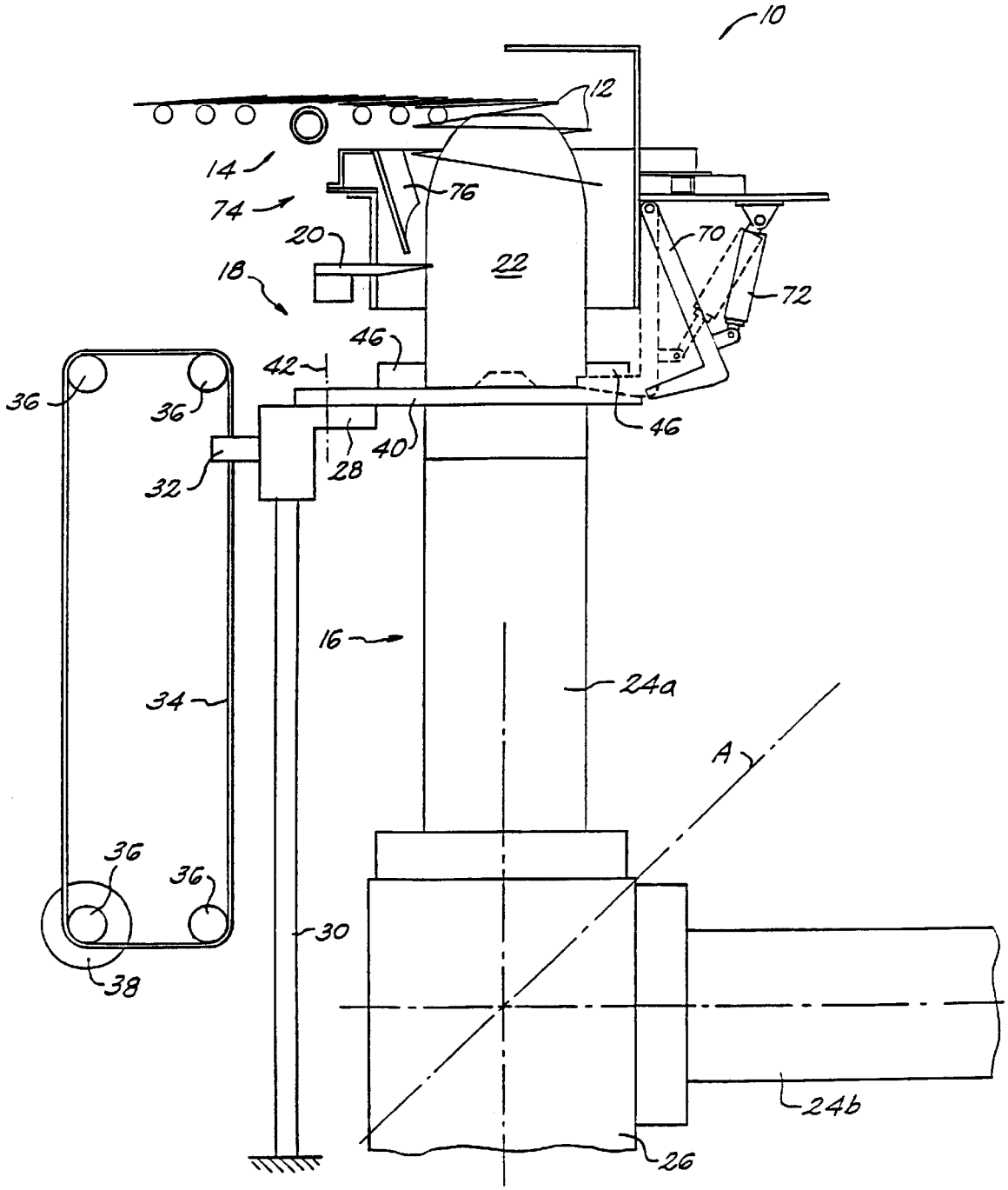
FIG. 1 depicts a reforming chamber in accordance with the present invention.
Figure 2:
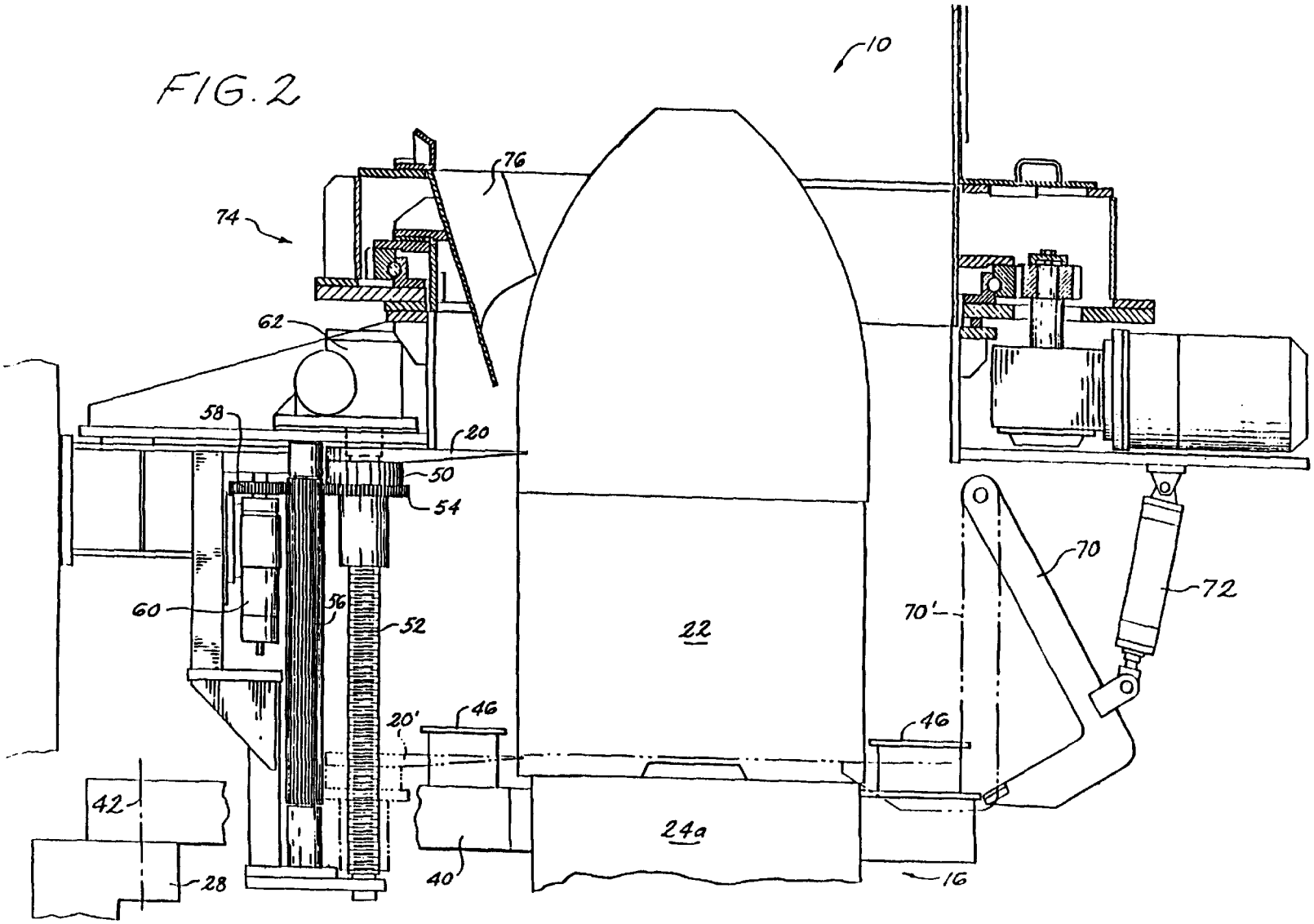
FIG. 2 is an enlarged view of the upper end of the reforming chamber shown in FIG. 1.
Figure 3:
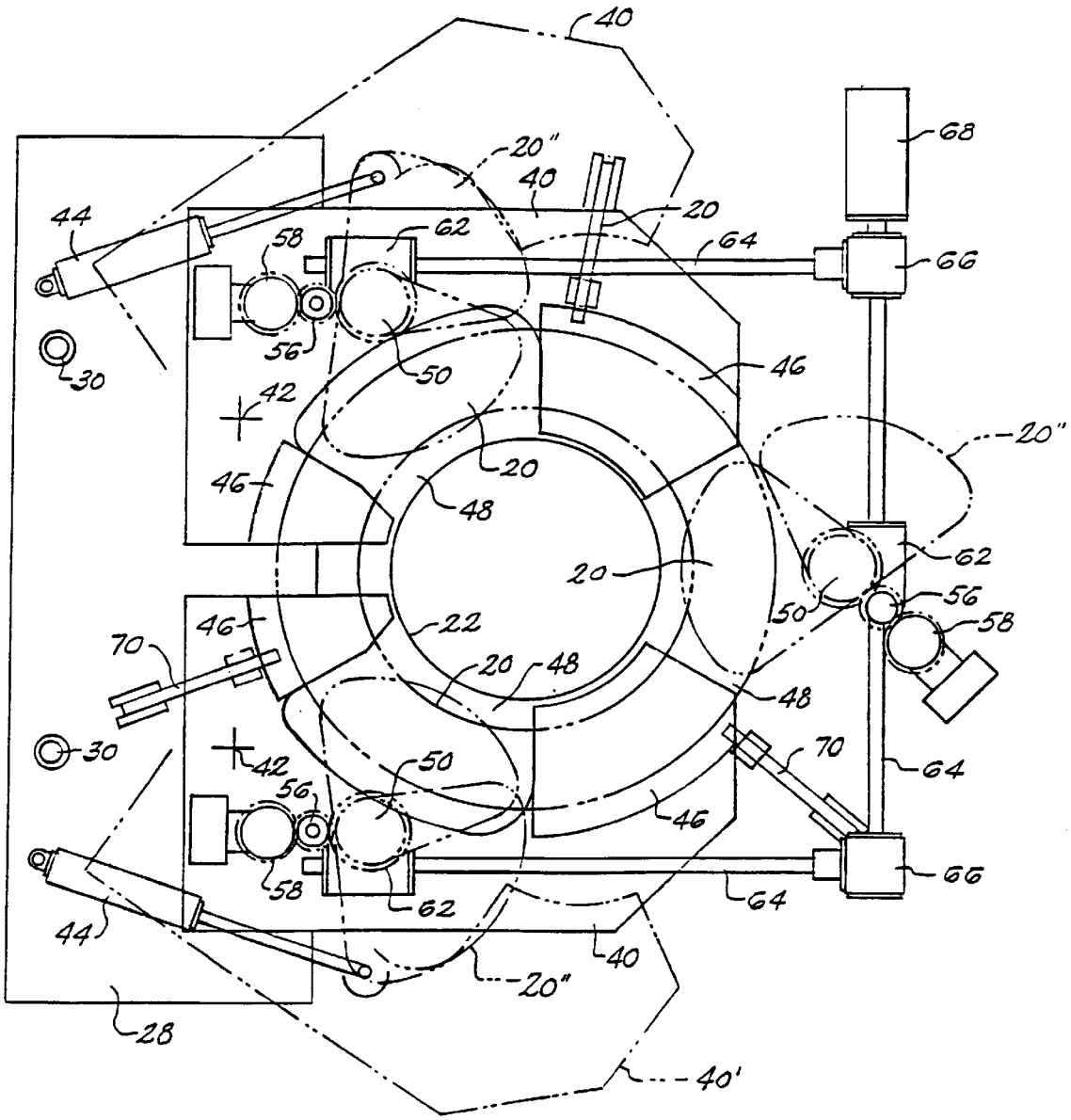
FIG. 3 is a view looking down on the coil plate and ring interceptors.

With reference initially to FIGS. 1–3, a reforming chamber in accordance with the present invention is shown at 10. The reforming chamber is positioned to receive a helical formation of rod rings 12 free falling from the delivery end of a conveyor 14.

The reforming chamber includes a vertically disposed guide generally indicated at 16, a vertically adjustable coil plate assembly 18, and vertically adjustable interceptor elements 20. The guide 16 is subdivided into an upper nose cone 22 positioned for encirclement by the helical formation of free falling rings 12, and one of two underlying mandrels 24*a*, 24*b*. The mandrels are carried on a base 26 which is rotatable about an axis A disposed at a 45° angle with respect to the mandrel axes. Each mandrel is axially adjustable with respect to the base 26 by conventional means (not shown). At the operational stage shown in FIG. 1, the nose cone 22 is supported on the mandrel 24*a*.

The coil plate assembly 18 includes an elevator 28 moveable vertically along guide posts 30 or the like. The elevator is connected as at 32 to cables or chains 34 extending around sheaves or sprockets 36, one of which is driven by a motor 38. The elevator 28 carries a pair of arms 40. With reference in particular to FIG. 3, it will be seen that the arms 40 are pivotally adjustable about axes 42 by means of linear actuators 44. The arms 40 are provided with raised pedestals 46 spaced one from the other to define gaps 48 therebetween. The linear actuators 44 operate to pivotally manipulate the arms 40 between closed positions as shown by the solid lines, and open positions as indicated at 40' by the broken lines.

The interceptor elements 20 are generally paddle-shaped, and as can best be seen in FIG. 2, are carried on heads 50 which are threaded internally for engagement with vertical screws 52. Each head 50 has an external ring gear 54 meshed with a splined shaft 56 extending in parallel relationship to the adjacent screw 52. A second gear 58 is also meshed with splined shaft 56, and is driven by a motor 60. Each screw 52 is each driven by an individual dedicated actuator 62. The actuators 62 are mechanically interconnected by shafts 64 and right angle gear boxes 66 and are powered by a common drive motor 68. The drive motor 68 operates to rotate the screws 52 in unison to thereby vertically adjust the interceptor elements 20 between raised positions as shown by the solid lines in FIG. 2, and lowered positions as indicated by the broken lines at 20' in the same view. When in their lowered positions, the interceptor elements 20 are below the top surfaces of the pedestals 46 when the elevator assembly 18 is in its uppermost position.

The motors 60 are operable to rotate the splined shafts 56 in unison, thereby rotatably adjusting the interceptor elements 20 between operative positions as shown by the solid lines in FIG. 3, and inoperative positions shown at 20" by the broken lines in the same view. When operatively positioned, the interceptor elements 20 are aligned vertically with the gaps 48 between the pedestals 46, and when inoperatively positioned, the interceptor elements are outboard of the arms 40 carrying the pedestals.

Support members 70 are arranged around the nose cone 22, and are pivotally adjustable by means of linear actuators 72 between retracted positions as shown by the solid lines in FIG. 2, and operative positions as indicated at 70' by the broken lines in the same view.

A ring distributor 74 of the type described in U.S. Pat. No. Re. 35,440, the disclosure of which is herein incorporated by reference, is operable in the area surrounding the upper end of the nose cone 22. The ring distributor includes a rotating curved guide plate 76 which serves to deflect and horizontally distribute the rings 12 as they fall from the delivery end of the conveyor 14.

The operation of a reforming chamber in accordance with the present invention will now be described with further reference to FIGS. 4A–4F. At the operational stage depicted in FIG. 4A, the mandrel 24*a* has been axially elevated to support the nose cone 22, thereby allowing the support members 70 to be retracted to their inoperative positions. Rings 12 have begun to accumulate temporarily on the interceptor elements 20. The drive motor 68 has been energized to begin lowering the interceptor elements 20 at a rate calculated to maintain the top of the temporarily accumulating rings at a level "L", which is the level at which ring free fall is interrupted. At this stage, the coil plate assembly 18 has been returned to its fully elevated position. The rotating guide plate 76 of the ring distributor 74 operates to distribute the rings into the desired pattern as their free fall is arrested at level L.

Figure 4B:
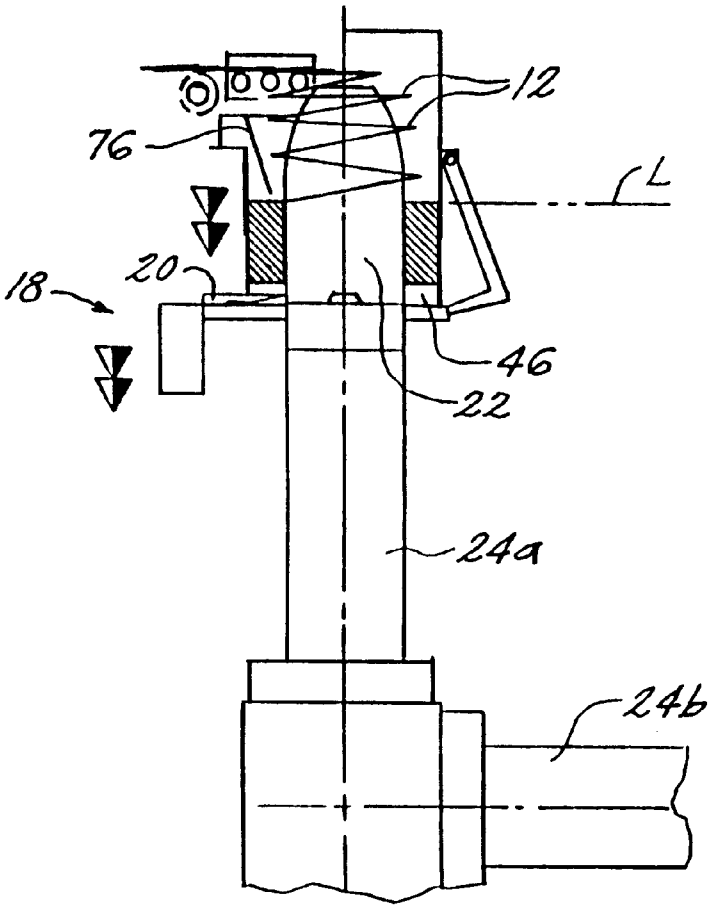
FIGS. 4A–4F are diagrammatic illustrations of various stages during a coil forming operation in accordance with the present invention.

At the operational stage depicted in FIG. 4B, the intercepting elements 20 have been lowered into the gaps 48 between the pedestals 46 of the coil plate assembly 18, thereby smoothly transferring the accumulation of rings from the interceptor elements onto the pedestals without any abrupt drop. Motor 38 has been energized to begin lowering the coil plate assembly, the net result being that as coil formation continues, the interruption of ring free fall continues to take place at level L.

Figure 4A:
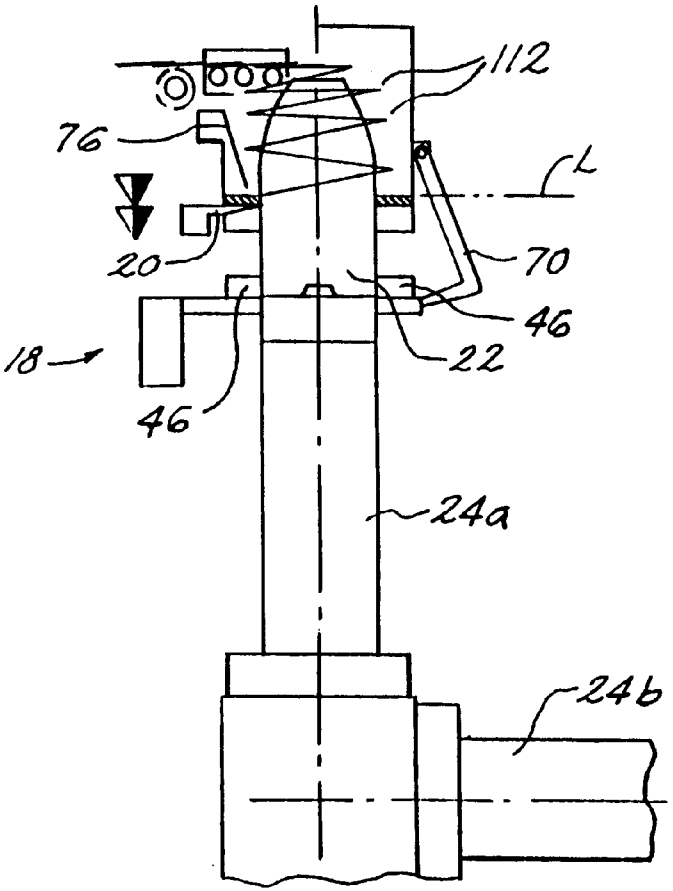

As soon as support for the accumulating coil is transferred to the coil plate assembly, the motors 58 are energized to rotate the interceptor elements 20 to their open positions 20" (see FIG. 3). Thereafter, as depicted in FIG. 4C, the interceptor elements are returned to their fully elevated positions as the coil plate assembly continues to be lowered to accommodate the growing coil while maintaining ring free fall interruption at level L.

Figure 4D:
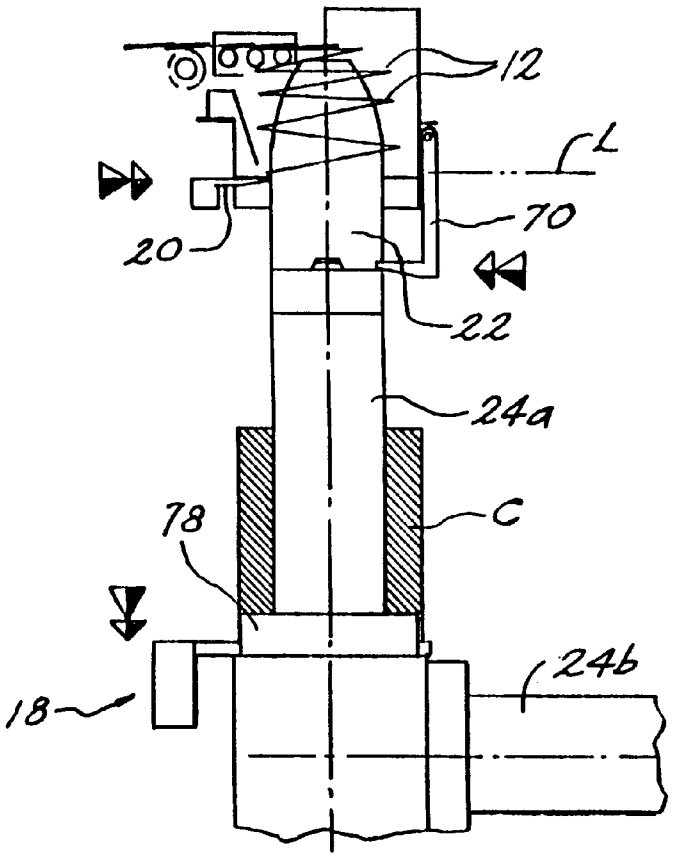
Figure 4C:
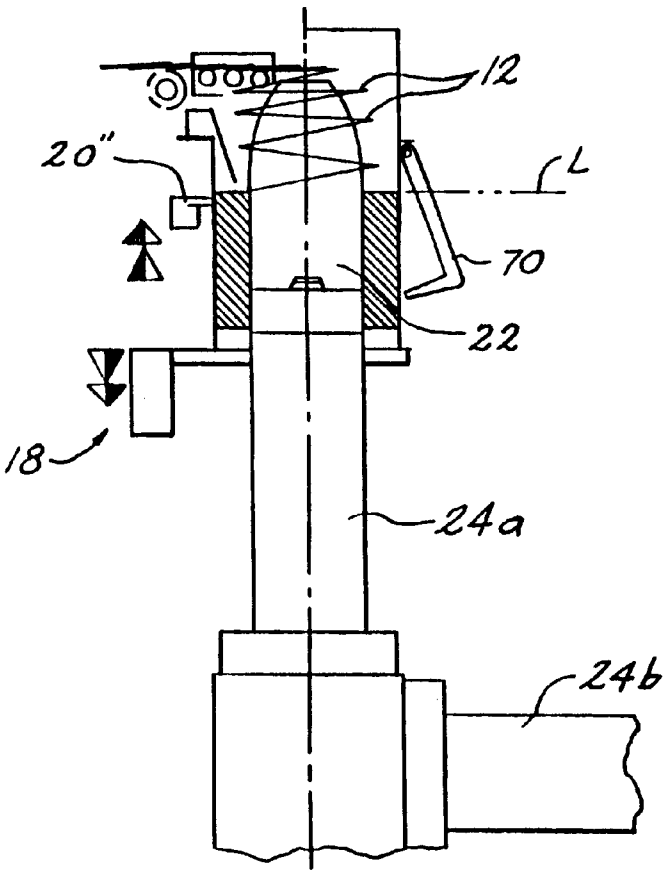

At the operational stage shown in FIG. 4D, coil formation has been completed, and the coil plate assembly 18 has been lowered to transfer the completed coil "C" onto an annular ledge 78 at the base of the mandrel 24*a*. The interceptor elements 20 have been rotated inwardly to their operative positions, and the support members 70 have been pivoted inwardly to engage the nose cone 22. Rings 12 from the next billet length of rod are beginning to arrive where they will accumulate temporarily on the operatively positioned interceptor elements 20.

Figure 4F:
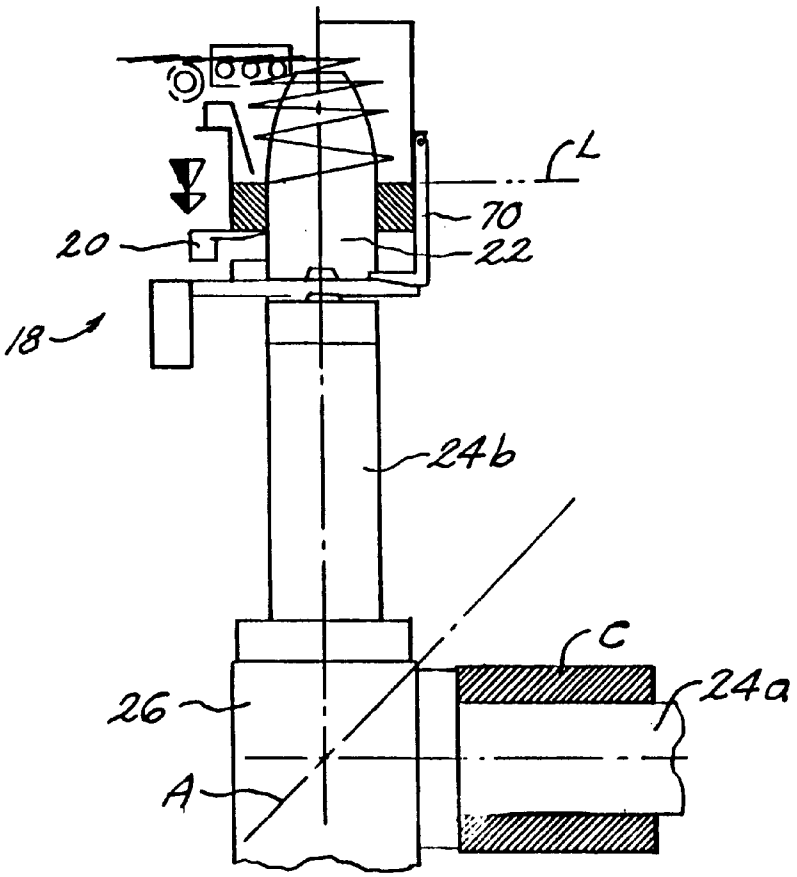
Figure 4E:
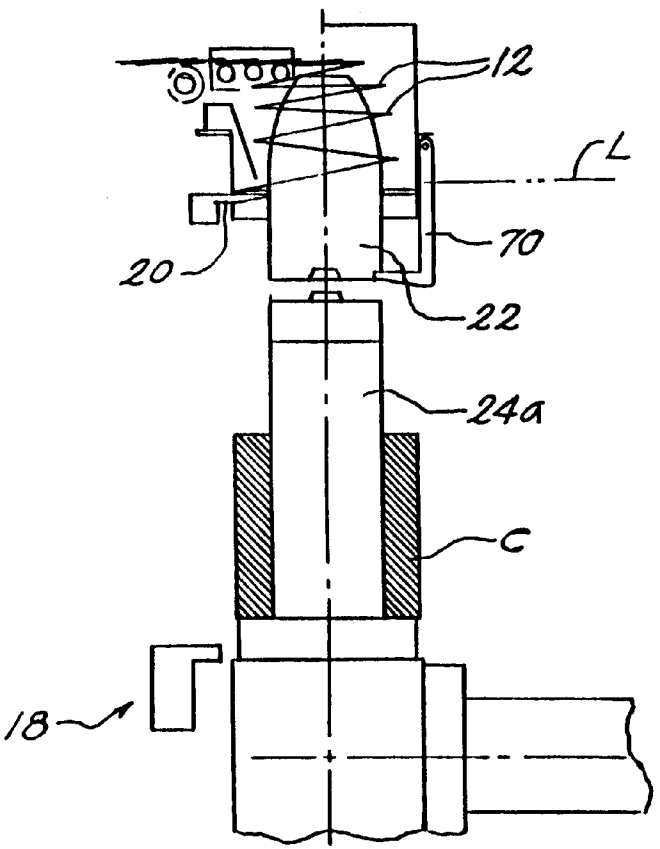

Next, as depicted in FIG. 4E, the mandrel 24*a* is axially lowered away from the nose cone 22, and the arms 40 of the coil plate assembly are opened to the positions indicated at 40' in FIG. 3. While this is taking place, rings are beginning to accumulate again on the operatively positioned interceptor elements 20, and these are again being lowered gradually to maintain ring free fall interruption at level L.

At the next operational stage shown in FIG. 4F, the mandrel base 26 has been rotated about axis A to position mandrel 24*a* horizontally in order to accommodate removal of the completed coil C. Mandrel 24*b* is now aligned beneath the nose cone 22. The coil plate assembly 18 has been returned to its fully elevated position, and the arms 40 have been closed about the mandrel 24*b*. The mandrel 24*b* is then axially raised to the position previously occupied by mandrel 24*a*, as shown in FIG. 4A, and the support members 20 are again pivotally retracted. Another coil forming cycle then continues as the completed coil C is cleared from mandrel 24*a*.

In light of the foregoing, it will now be evident to those skilled in the art that the present invention offers significant advantages over conventional coil forming methods and apparatus. Of particular importance is the interruption of ring free fall at a substantially constant level L. This is made possible by the controlled gradual lowering of the accumulating rings, initially while supported on the ring interceptor elements 20 and then while supported on the coil plate assembly 18. By maintaining the interruption of ring free fall approximately at level L, the effectiveness of the ring distributor 74 is maximized because the rotating guide plate 76 contacts and locates the descending rings as they arrive on the top of the accumulating coil.

By allowing the ring interceptor elements 20 to descend gradually into the gaps 48 between the pedestals 46 of the coil plate assembly 18, a smooth transition is effected, without sudden drops that could disturb ring patterns and produce troublesome overlaps. Coil density is therefore maximized, which contributes to a more compact stable coil structure.

It will be appreciated that various changes and modifications can be made to the above described embodiment without departing from the spirit and scope of the invention as defined by the appended claims. For example, and without limitation, functionally equivalent mechanisms other than those described may be employed to manipulate the mandrels, coil plate assembly, interceptor elements and other components of the apparatus.

We claim:

1. Apparatus for receiving a helical formation of rings free falling from the delivery end of a conveyor, and for forming said rings into an upstanding cylindrical coil, said apparatus comprising:

a vertically disposed guide having an upper end positioned for encirclement by said free falling rings;

a coil plate assembly vertically adjustable with respect to said guide between raised and lowered positions, said coil plate having a support surface interrupted by gaps;

interceptor means for interrupting the free fall of said rings at a first level between the upper end of said guide and the support surface of said coil plate at said raised position and for temporarily accumulating said rings on said interceptor means;

first operating means for transferring the rings accumulated on said interceptor means onto said coil plate assembly by lowering said interceptor means from said first level through the gaps in the support surface of said coil plate assembly to a second level beneath said support surface;

second operating means for removing said interceptor means from beneath said support surface; and third operating means for lowering said coil plate assembly to said lowered position to thereby accommodate continued accumulation of rings thereon around said guide to complete formation of said coil.

2. The apparatus as claimed in claim 1 wherein said intercepting means and said coil plate assembly are lowered respectively by said first and second operating means at times and at rates selected to maintain the interruption of the free fall of said rings at approximately said first level.

3. The apparatus as claimed in claim 1 wherein said guide is subdivided into an upper nose cone carried on a lower mandrel, said mandrel having a height sufficient to axially support a fully formed coil and being separable from said nose cone to accommodate removal of said coil therefrom, and support means for carrying said nose cone during separation of said mandrel therefrom.

4. The apparatus as claimed in claim 1 wherein said interceptor means comprises a plurality of vertically disposed screws located at intervals around said guide, each of said screws having a nut member threaded thereon, and each of said nut members in turn carrying an interceptor element rotatable about the axis of its respective screw, and means for rotating said screws to vertically adjust said nut members and the interceptor elements carried thereon.

5. The apparatus as claimed in claim 4 wherein said second operating means comprises splined shafts parallel to said screws, pinion gears integrally associated with each of said interceptor elements and in engagement with a respective one of said splined shafts, and means for rotating said splined shafts in unison.

6. A method of receiving a helical formation of rings free falling from the delivery end of a conveyor and for gathering said rings into an upstanding cylindrical coil, comprising:

positioning a vertically disposed guide for encirclement by said free falling rings;

supporting an initial accumulation of said rings on interceptor elements, with the top of said accumulation defining the elevation at which the free fall of said rings is interrupted;

gradually lowering said interceptor elements to transfer said accumulation onto an underlying coil plate assembly, and;

continuing to lower said coil plate assembly to complete the formation of said coil around said guide, with the timing and rate of descent of said interceptor elements and said coil plate assembly being selected and controlled to maintain the interruption of ring free fall at approximately said elevation.

* * * * *